United States Patent [19]

Bedford

[11] Patent Number: 4,866,800

[45] Date of Patent: Sep. 19, 1989

[54] SUPPORT PAD FOR NONAMBULATORY PERSONS

[76] Inventor: Peter H. Bedford, 3817 Mistral Ave., Huntington Beach, Calif. 92649

[21] Appl. No.: 318,675

[22] Filed: Mar. 3, 1989

Related U.S. Application Data

[60] Division of Ser. No. 195,968, May 19, 1988, which is a continuation-in-part of Ser. No. 123,052, Nov. 19, 1987, abandoned.

[51] Int. Cl.[4] ..... A47C 27/14; A61G 7/00

[52] U.S. Cl. ..... 5/468; 5/481

[58] Field of Search ..... 5/468, 481, 462, 464, 5/448, 431, 469

[56] References Cited

U.S. PATENT DOCUMENTS

| | | | |
|---|---|---|---|
| 2,688,070 | 8/1954 | Freedlander | 5/481 |
| 3,266,064 | 8/1966 | Figman | 5/469 |
| 3,681,797 | 8/1972 | Messner | 5/469 |
| 3,818,522 | 6/1974 | Schuster | 5/468 |
| 4,686,724 | 8/1987 | Bedford | 5/468 |
| 4,688,285 | 8/1987 | Roberts | 5/481 |

FOREIGN PATENT DOCUMENTS

| | | | |
|---|---|---|---|
| 497491 | 3/1970 | Australia | 5/481 |
| 3017379 | 11/1981 | Fed. Rep. of Germany | 5/468 |
| 596399 | 9/1925 | France | 5/469 |
| 1090785 | 4/1955 | France | 5/468 |
| 1310373 | 3/1973 | United Kingdom | 5/468 |
| 2032269A | 5/1980 | United Kingdom | 5/468 |

*Primary Examiner*—Alexander Grosz

*Attorney, Agent, or Firm*—Price, Gess & Ubell

[57] ABSTRACT

A foam support pad for nonambulatory persons provides for a wide weight distribution and maximum aeration of skin areas in contact with the pad to prevent the formation of decubitus ulcers. The top surface of the pad has an array of protuberances and valleys thereon, with air channels extend through the pad. Air channel cores are located beneath the protuberances, with some of the air channel cores extending close till the top of the protuberances, and other of the air channel cores extending through the top portions of the protuberances.

5 Claims, 4 Drawing Sheets

SUPPORT PAD FOR NONAMBULATORY PERSONS

This application is a division of an application entitled "Support Pad for Nonambulatory Persons", having U.S. Ser. No. 195,968, filed May 19, 1988, which is in turn a continuation-in-part of an application entitled "Support Pad For Nonambulatory Persons" and having U.S. Ser. No. 123,052, filed on Nov. 19, 1987, (now abandoned).

BACKGROUND OF THE INVENTION

1. Field of the Invention

The present invention relates to specialty pads or cushions, and more particularly pertains to padding used by nonambulatory persons as bed pads or chair pads to distribute the contact between parts of their body and a reclining surface and further, to maximize aeration of body parts in contact with the pad. Proper weight distribution and adequate aeration can prevent the occurrence of decubitus ulcers.

2 Description of the Prior Art

Those concerned with manufacturing and selling pads to be used by nonambulatory persons as bed pads or chair pads, for example, have been aware of the need for providing for ample air circulation around the injured or immobile areas of the body. Actually, an injured area of the body requires more air circulation than a healthy part which is simply immobile.

An open-cell foam pad that has been cut to form an alternating array of projections and ventilated depressions has been found to be most beneficial in preventing the formation of decubitus ulcers. U.S. Pat. No. 4,686,724 issued to Bedford on Aug. 16, 1987, describes in detail the advantages of such a paid.

Alternative designs, in addition to methods of manufacture, are disclosed in U.S. Pat. No. 4,603,445 issued to Spann on Aug. 5, 1986.

Those designs that provide for adequately distributed support do not provide for adequate access of fresh outside air to the supported portions of the anatomy. The movement of fresh outside air towards the interior of the pad, for the most part, is limited to passive diffusion through the open-cell foam structure of the pad. No clear path is available, and no additional boost of this flow is provided nor can a means for generating this boost be accommodated. In addition, no means for adjusting the temperature of any incoming air is provided nor can a means for achieving this adjustment be easily accommodated.

SUMMARY OF THE INVENTION

It is an object of the present invention to provide a pad that both maximizes weight distribution of an anatomy in repose thereon and provides for significantly increased aeration of the skin areas in contact with the pad.

It is a further object of the present invention to provide for boosted airflow within the pad. Another object is to be able to cool or heat the air flowing towards the supported skin areas.

According to the present invention, these objectives are achieved and the shortcoming of the prior art are overcome by a multi-layered foam support pad. The upper layer, which is intended to contact the anatomy, has a series of protuberances and valleys thereon. A middle layer accommodates an electrically driven fan.

A lower layer has a series of grooves on its bottom face to enhance airflow towards the interior of the pad. Air channels interconnect the bottom face of the lower layer with the top face of the upper layer. Reticulated foam material having an especially open structure is used in the lower layer and thereby maximizes airflow from the outside through the bottom layer and up to the skin areas in contact with the support pad. Alternatively, ice packs or heating pads are accommodated in the lower layer so that a desired temperature adjustment can be achieved.

BRIEF DESCRIPTION OF THE DRAWINGS

Many of the attendant advantages of this invention will be readily appreciated as the invention becomes better understood by reference to the following detailed description when considered in conjunction with the accompanying drawings in which like reference numerals designate like parts throughout the figures thereof and wherein.

DESCRIPTION OF THE PREFERRED EMBODIMENTS

Figure 1:
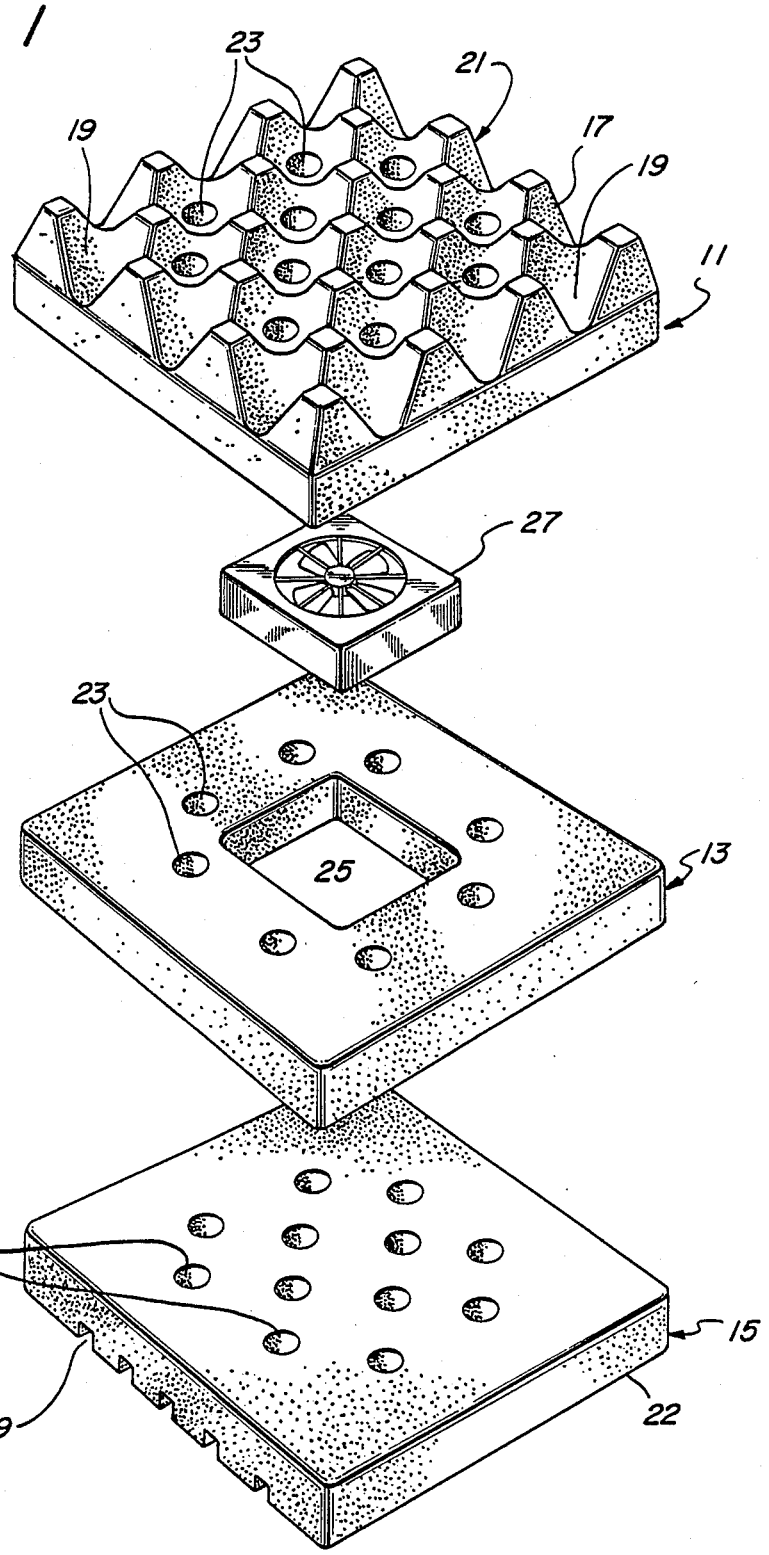
FIG. 1 illustrates an exploded, perspective view of the structure of a preferred embodiment of this invention.

FIG. 1, illustrates a preferred embodiment of the nonambulatory support pad, shows an exploded, perspective view of the structure of the pad. The support pad is composed of three foam layers, an upper layer 11, a middle layer 13 and a lower layer 15. The upper layer 11 has a uniform array of protuberance or hills 17 and valleys 19 across the top face. The hills 17 have tops 21 and each valley has an air channel 23 extending from the bottom of the valley through the body of the foam pad. This top face of the upper layer is intended to contact the anatomy of the individual in repose upon the pad. The described arrangement provides for the least amount of pressure to any one part of the body while providing for maximum air circulation to those areas of the body contacting the surface of the pad. The area of each valley 19 is about $1\frac{1}{2}$ inches by $1\frac{1}{2}$ inches. The depth of each valley from the plane described by the protuberances 21 to the floor of the valley is about 1 inch. Each area 21 is at least $\frac{1}{2}$ inch by $\frac{1}{2}$ inch. The overall height of this layer from its bottom face to the projections is about $1\frac{3}{4}$ inches. The airflow channels 23 throughout the pad are at least $\frac{5}{8}$ inch in diameter. In order to support heavier individuals, the areas 21 may be increased in area and in no event, however, shall they exceed a diameter larger than $1\frac{1}{4}$ inches. This is the upper size limit of the contact surface for the individual hills 21. It has been discovered that a skin area of $1\frac{1}{4}$ inches in diameter, even though denied air circulation, can sustain itself from air circulating in adjacent areas whereas larger areas cannot. By limiting the individual contact surfaces to this size or smaller, the user of the pad is assured of obtaining sufficient oxygen to all parts of his body surface. This virtually eliminates the occurrence of decubitus ulcers even for the most immobile patients.

The middle layer consisting of open-cell foam material is about 2½ inches thick and is joined to the bottom face of the upper layer via a suitable adhesive. Air channels 23 extend completely through this layer and coincide with the air channels in the upper layer 11. A cutout 25 in the center of the middle layer accommodates an electrically driven fan 27. Blades of the fan rotate about a vertical axis and boost airflow from below up through the foam support pad to maximize air flowing to the skin areas contacting the pad. This fan is preferably driven by a low-voltage DC motor powered by either an incorporated battery pack or a remote power supply.

For the lower level 15, a reticulated foam material is used. Reticulated foam is the product of a process in which open-cell foam material is subjected to a cleansing process that clears out much of the membrane structure and leaves an especially open structure. This feature is, of course, especially suited for incorporation in the present invention as it allows greater freedom of air movement throughout the body of this layer. In addition, the air channels 23 can be extended through this lower level, their positions coinciding with the position of the air channels in the layers above.

Figure 2:
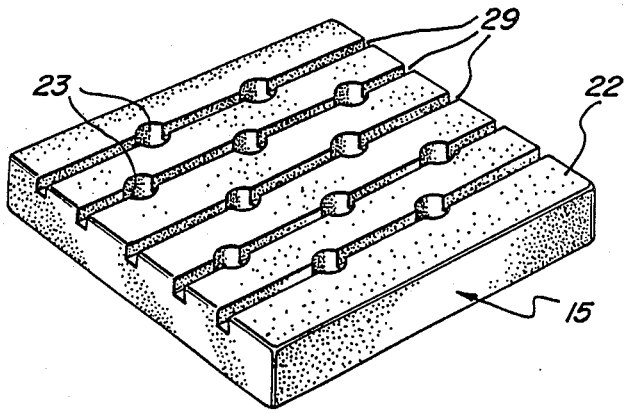
FIG. 2 shows the bottom face of the lower layer of FIG. 1.

Another feature of the present invention is the addition of an array of grooves 29 on the bottom face of the lower layer of foam. The grooves, ⅛ to ¼ inch wide and about ½ inch deep, interconnect the air channels 23 and extend to the periphery of the support pad to provide for even greater airflow towards and throughout the interior of the support pad. FIG. 2 more clearly shows the bottom face 22 of the lower layer 15 of the support pad. The grooves 29 run the full length or width of the support pad and interconnect the air channels 23.

Figure 3:
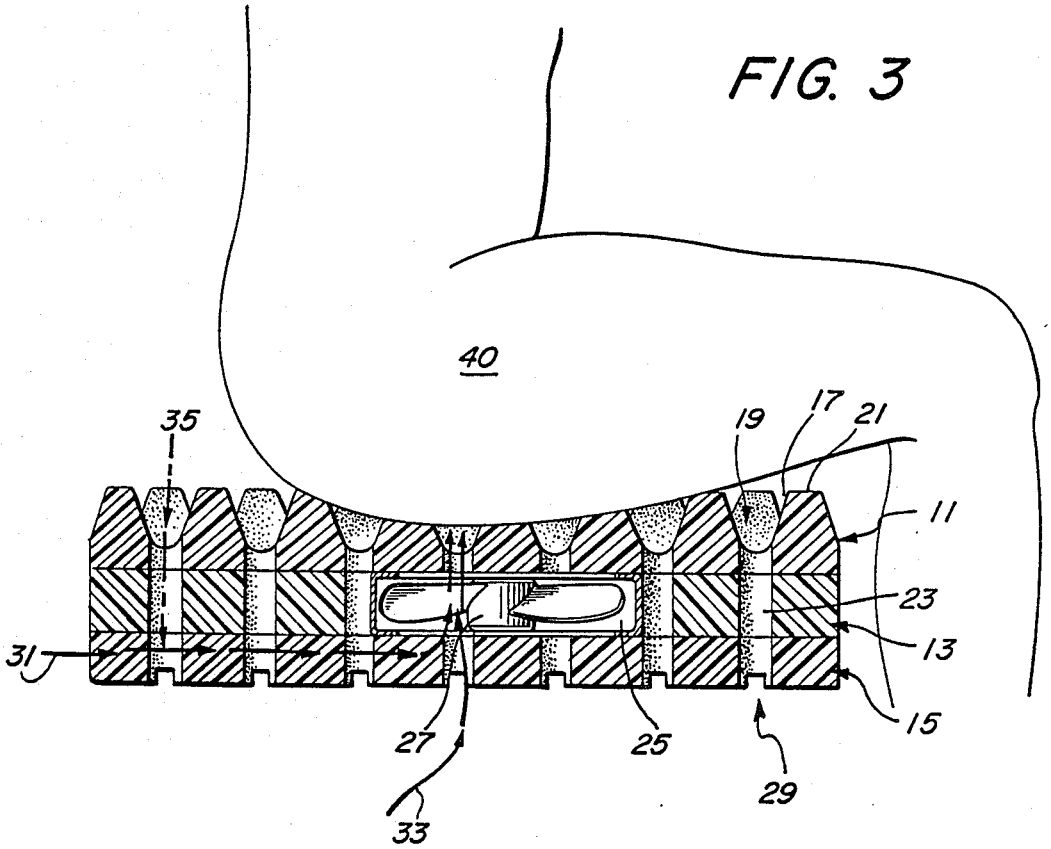
FIG 3 shows a cross-section of the structure illustrated in FIG. 1 supporting a person in repose thereon.

An alternative embodiment combines only the upper layer 11 and the lower layer 15 without incorporating the middle layer 13 and fan 27. FIG. 3 illustrates a cross-section of the pad illustrated in FIG. 1. A person 40 on repose on the pad compresses the protuberances 17 and the profile thereof prevents the protuberances from folding over and closing off the air channels 23. The fan 27 draws fresh outside air in through a number of paths; 33 illustrates the path of least resistance. Fresh outside air flow is conducted in from the periphery of the pad via the grooves 29 up through the air channels 23 past the fan 27 and on up through the upper layer 11. The open structure of the reticulated foam layer 15 does not preclude air movement throughout the body of this layer and 31 thereby illustrates another possibility of fresh outside air flow. In addition, air channels not blocked off by parts of the anatomy in contact with the support pad can conduct air flow first downwardly towards the reticulated layer, as illustrated by 35, and then over towards and up through the fan on towards the skin areas in contact with the pad.

While the air channels enhance airflow throughout the support pad, airflow is not limited to these channels. The open-cell foam structure allows air movement throughout the body of the foam. Additional air channels, although not directly involved in the main airflow as boosted by the fan 27, participate in the aeration of skin areas in contact with the pad. Fresh air movement within the reticulated foam layer 15 continuously replenishes air at the bottom of such channels which is subsequently moved up in contact with the body via passive thermocline airflow.

Figure 4:
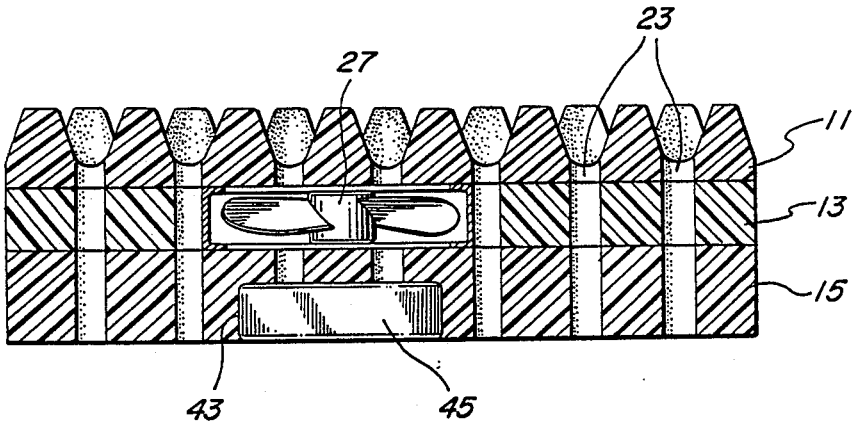
FIG. 4 illustrates a cross-section of an alternative embodiment.
Figure 5:
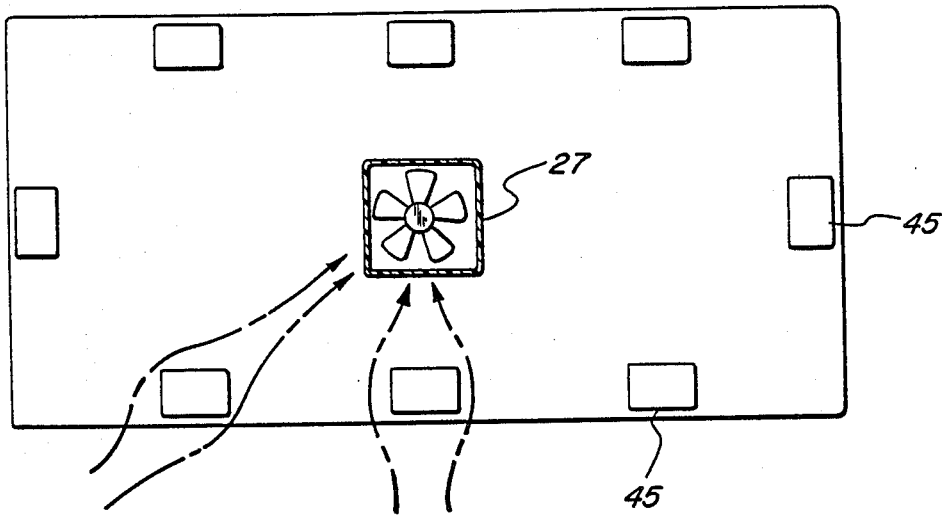
FIG. 5 is a bottom plan view of another alternative embodiment of the present invention.

Often it is desirable, either for medical reasons or to enhance the comfort of the person in repose on the pad, to either heat or cool the airflow being conducted towards the skin areas in contact with the pad. FIG. 4 illustrates a cross-section of a pad similar to that pictured in FIG. 1 and FIG. 3 but with the addition of a cutout 43 in the lower layer of the pad to accommodate a cold pack 45. Air flowing by the cold pack, as it is drawn in by the fan 27 and directed upwardly towards the skin areas in contact with the pad, is thereby cooled. Alternatively, if it is necessary or desirable to warm the incoming air, a heating pad can be similarly positioned. Alternatively, as illustrated in FIG. 5, a plurality of cold packs or heating pads can be accommodated in cutouts positioned near the periphery of the pad to affect the air temperature as it is drawn into the pad towards the fan 27.

Figure 6:
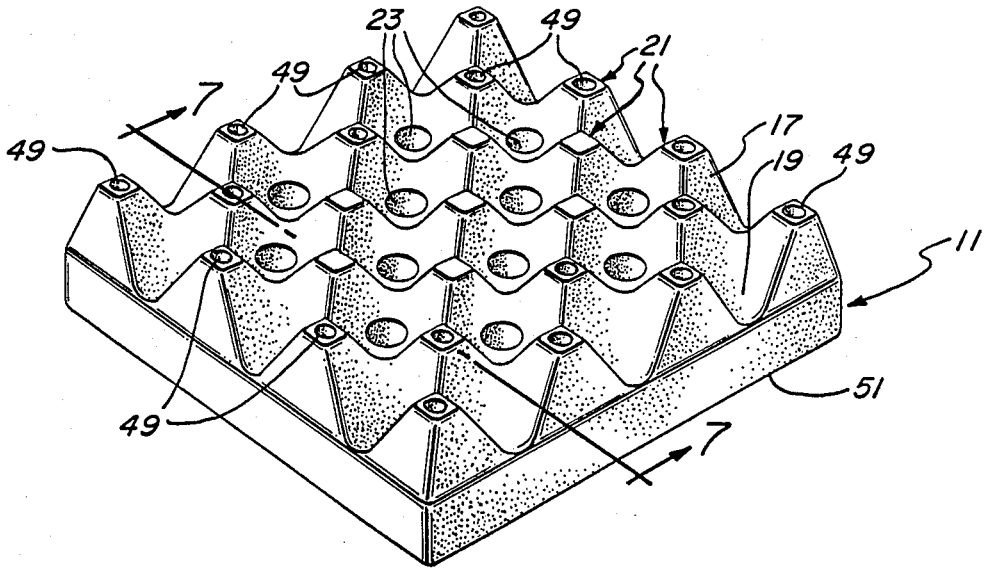
FIG. 6 is perspective of an alternate embodiment according to the present invention.

An alternate preferred embodiment for an upper layer 11 of a multi-layered support pad shown in FIG. 1, is illustrated in FIG. 6. This pad besides having great utility as an upper layer of a multi-layered pad as shown in FIG. 1 also finds considerable utility and has great advantage over the prior art as a single layer pad. The foam pad of FIG. 6 may have a foam body 11 made out of a variety of materials including a foam material sold as INSULITE by Uniroyal or any other open or closed cell foam material, which has a somewhat denser consistency.

The foam pad of FIG. 6 is shown as having a plurality of hills 17 with valleys 19 therebetween. Each of the valleys, as illustrated, has an air channel 23 extending from the bottom of the valley through the body of the foam pad to the bottom face or second major side 51. The first major side on the top face of the foam pad of FIG. 6 is the tops of the hills 21. Some of the hills 17 are shown as having an air channel core 49 extending from the second major side 51 to the first major side of the foam pad.

Figure 7:
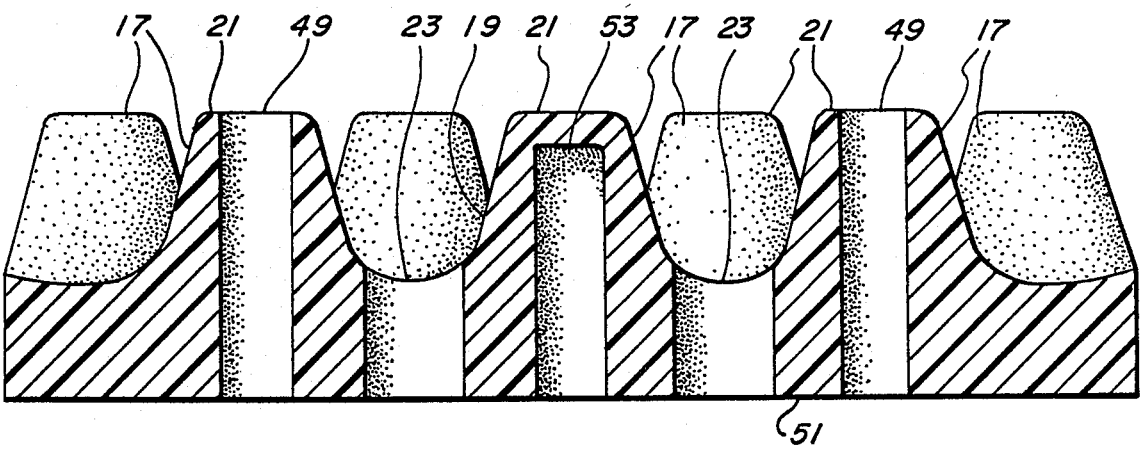
FIG. 7 is a cross-section of the structure in FIG. 6.

Referring now to FIG. 7, which illustrates a cross-section taken along line 7—7 of FIG. 6, it can be seen that certain of the hills 17 have air channel cores 53 extending from the second major side 51 into the interior of the foam body towards the peaks of the hills on the first major side but terminating short of reaching the first major side.

Both the air channel cores 49 that extend completely through the foam pad from one major side 51 to the other major side 21 and the air channel cores 53 which extend from the second major side through the body but terminate short of the first major side 21 function to reduce contact pressure. The dimensions of the air channel cores 49 and 53 may be varied depending on the size of the hills 17 and the thickness of the pad itself. Air channel core 49 provides for additional air flow through the pad to the anatomy surface contacting the pad whereas air channel core 53 tends to, especially in those foam pads which are made of closed cell foam, trap air therein creating an air cushion effect in support of the anatomy in contact therewith.

The features described in the above embodiments can be incorporated in full size bed pads or in cushions to be used with wheelchairs.

Obviously, many modifications and variations of the present invention are possible. In light of the above teachings, it is therefore to be understood that within the scope of the appended claims, the invention may be practiced otherwise than as specifically described.

What is claimed is:

1. A support pad for nonambulatory persons, said pad having a foam body with a first and second major side for supporting a human anatomy, the improvement in the pad comprising:

a substantially uniform distribution of hills of substantially uniform height and cross-section on the first major side of said foam body, said hills being separated by valleys of a substantially uniform depth and uniform cross-section, each of said hills having a top, each of said valleys having an airflow channel terminating at the valley floor and extending through said foam body to the second major side; and the second major side being substantially flat with a plurality of air channel cores terminating at the second major side underneath a plurality of the hills with a plurality of said air channel cores extending close to the top of the hills;

whereby the tops of the hills support a human anatomy with even weight distribution and reduced contact pressure, while facilitating increased air circulation to the parts of the human anatomy in contact with the support pad.

2. The support pad of claim 1 wherein said air channel cores equal in number, the number of hills on the first major side.

3. The support pad of claim 1 wherein said air channel cores are placed at locations in the pad body where a reduction in contact pressure is desired.

4. The support pad of claim 1 wherein a plurality of said air channel cores extend from the second major side of said pad completely through the body of the pad terminating at the tops of the hills on the first major side.

5. The support pad of claim 4 wherein said air channel cores equal in number the number of hills on the first major side.

* * * * *